US008087882B2

(12) United States Patent
Xu

(10) Patent No.: US 8,087,882 B2
(45) Date of Patent: Jan. 3, 2012

(54) FAN ASSEMBLY

(75) Inventor: Hong-Bo Xu, Shenzhen (CN)

(73) Assignees: Hong Fu Jing Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 698 days.

(21) Appl. No.: 12/241,056

(22) Filed: Sep. 30, 2008

(65) Prior Publication Data

US 2009/0317239 A1 Dec. 24, 2009

(30) Foreign Application Priority Data

Jun. 19, 2008 (CN) ..... 2008 1 0302222

(51) Int. Cl.
*F04D 29/70* (2006.01)

(52) U.S. Cl. ..... 415/121.2; 416/247 R

(58) Field of Classification Search ..... 415/121.2; 416/247

See application file for complete search history.

(56) References Cited

U.S. PATENT DOCUMENTS 7,654,309 B2 * 2/2010 Wu et al. ..... 165/80.3

FOREIGN PATENT DOCUMENTS

CN 2661968 Y 12/2004

* cited by examiner

*Primary Examiner* — Quoc Hoang
(74) *Attorney, Agent, or Firm* — Altis Law Group, Inc.

(57) ABSTRACT

A fan assembly includes a fan and a fan guard mounted on the fan to protect the fan from contamination and damage during operation. The fan includes a plurality of ears extending outwardly from a circumference thereof. The fan guard includes a frame and a hood made of net and mounted over the frame in a stretched manner. The frame includes a plurality of concentrically arranged annular ribs and a plurality of supporters connecting the annular ribs together. The annular ribs are spaced apart with predetermined spacing along an axial direction. A lowest one of the ribs of the frame is bent to form a plurality of fastening feet for extension of screws to threadedly engage with the ears of the fan. The hood has an outwardly convex periphery due to the configuration of the annular ribs.

14 Claims, 2 Drawing Sheets

FAN ASSEMBLY

BACKGROUND OF THE INVENTION

1. Field of the Invention

The present invention generally relates to a fan assembly, and particularly to a fan assembly having a fan and a fan guard mounted on an air intake of the fan to protect the fan from contamination and damage during operation.

2. Description of Related Art

Fans are widely used in many systems which generate heat and have a need of being kept at a normal working range of temperature. Oftentimes, the fans are mounted to the systems via fan holders.

A conventional fan assembly includes a fan and a fan duct attached to the fan. The fan commonly includes an airflow inlet and an airflow outlet. The airflow outlet faces a heat sink and the airflow inlet faces the fan duct so that the airflow produced by the fan can flow along a predetermined direction from the fan duct to the heat sink. However, blades of the fan are exposed and rotate rapidly when the fan is operated. So, the blades of the fan are easily to be contaminated by dust, and it is dangerous for an operator to touch the blades during operation of the fan. In addition, an intrusion of foreign article into the fan may cause damage to the rotating blades.

Therefore, a fan assembly having a fan and a fan guard mounted on the fan, which overcomes the above-mentioned problem is desired.

SUMMARY OF THE INVENTION

The present invention relates to a fan assembly. According to a preferred embodiment of the present invention, the fan assembly includes a fan and a fan guard mounted on the fan to protect the fan from contamination and damage during operation. The fan includes a plurality of ears extending outwardly from a circumference thereof. The fan guard includes a frame and a hood covering the frame and supported by the frame. The frame includes a plurality of annular ribs and a plurality of supporters connecting the annular ribs together. The annular ribs are concentrically disposed along an axial direction of the fan guard and spaced apart with predetermined spacing. The frame includes a plurality of fastening feet at a lower portion thereof for extension of screws to threadedly engage in the ears of the fan. The fastening feet are formed by bending a lowest one of the annular ribs. The hood is made of one of gauze and netting, thereby protecting the fan from contamination of dust and damage when airflow passes through the fan guard towards the fan. The hood has an outwardly convex periphery due a configuration of the annular ribs, wherein the annular rib immediately above the lowest annular rib has the largest diameter.

Other advantages and novel features will become more apparent from the following detailed description of preferred embodiments when taken in conjunction with the accompanying drawings.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
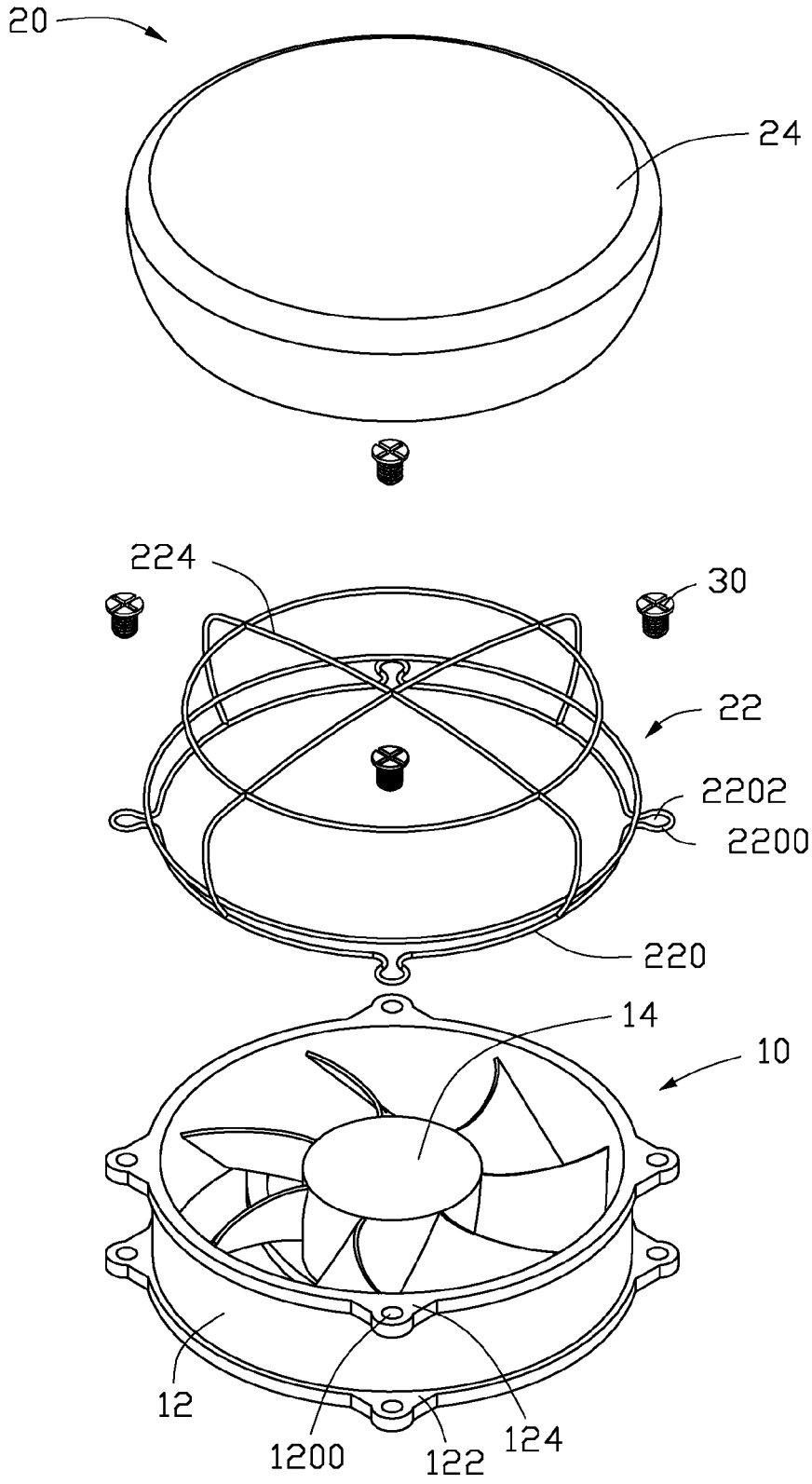
FIG. 1 is an isometric, exploded view of a fan assembly in accordance with a preferred embodiment of the present invention.
Figure 2:
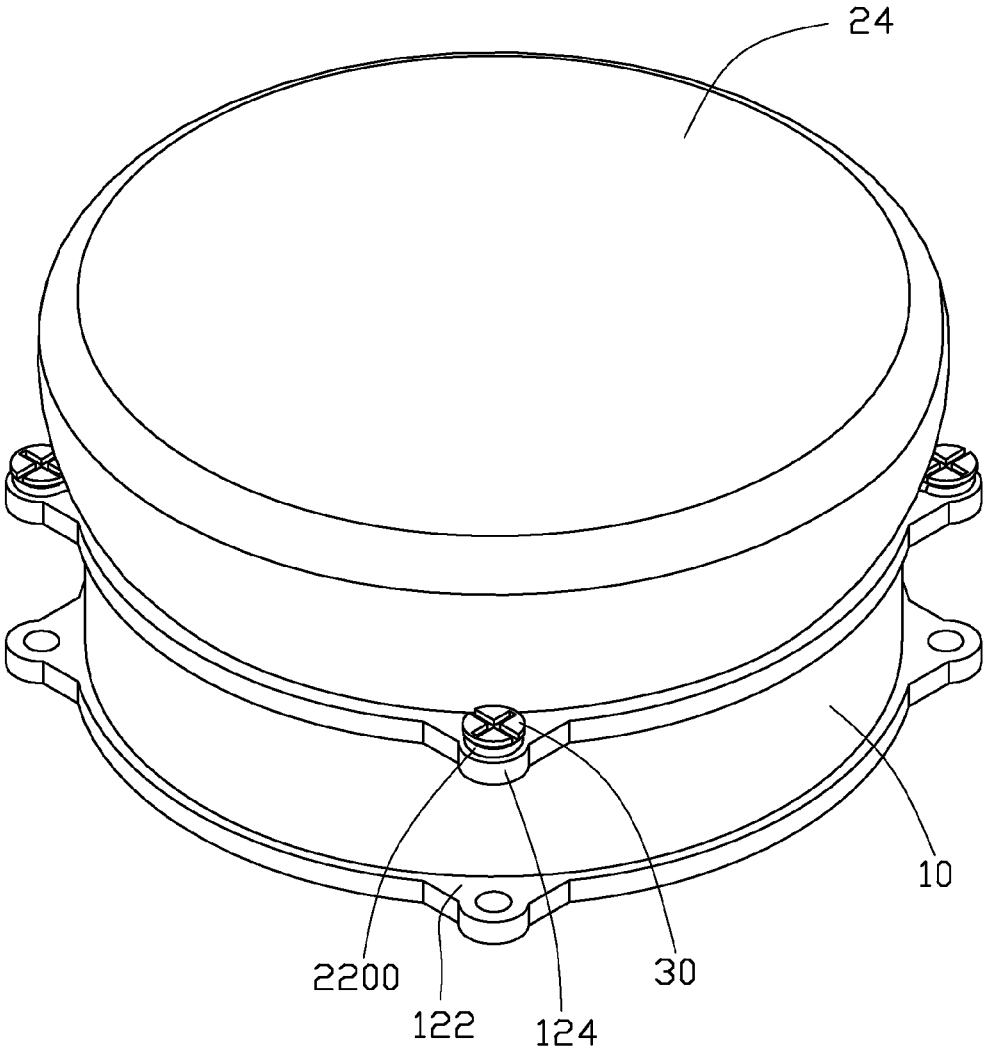
FIG. 2 is an assembled view of FIG. 1.

Referring to FIGS. 1-2, a fan assembly in accordance with a preferred embodiment of the present invention is illustrated. The fan assembly has a fan 10 and a fan guard 20 mounted on the fan 10 to protect the fan 10 from contamination of dust and damage during operation.

The fan 10 comprises a circular hollow body 12 and a motor 14 received in the body 12. The body 12 forms four pairs of triangle ears extending outwardly from a circumferential sidewall thereof. Each pair of the ears comprises a lower ear 122 and an upper ear 124 spaced from and opposite to the lower ear 122. A threaded hole 1200 is defined in each ear 122, 124 and the threaded holes 1200 of the upper ears 124 are provided for threadedly engaging with screws 30.

The fan guard 20 has a frame 22 and a hood 24 covering on the frame 22 and supported by the frame 22. The frame 22 is made of metal wires and comprises three annular ribs 220 and two pairs of supporters 224 interconnecting the annular ribs 220 together. The annular ribs 220 are concentrically disposed along an axial direction of the frame 22 and spaced apart with predetermined spacing. The three annular ribs 220 comprise a lower, a middle and an upper annular ribs 220 along a bottom-top direction of the frame 22. The lower annular rib 220 forms four annular fastening feet 2200 extending outwardly from a circumference thereof. Each fastening foot 2200 defines a through hole 2202 therein for extension of the screw 30. The fastening feet 2200 are integrally formed with the lower annular rib 220 by bending the lower annular rib 220. The lower annular rib 220 has a diameter similar to an outer diameter of the body 12 of the fan 10 to thereby facilitate positioning the frame 22 of the fan guard 20 on a top portion of the body 12 of the fan 10. The middle annular rib 220 has a largest diameter and the upper annular rib 220 has a smallest diameter, thereby forming an outwardly convex periphery when the hood 24 is mounted to the frame 22, to provide a larger space for airflow produced by the fan 10 passing through the fan guard 20 and entering the fan 10. The middle annular rib 220 is located adjacent to the lower annular rib 220 and distant from the upper annular rib 220.

The two pairs of supporters 224 are intercrossed at a top apex of the frame 22 of the fan guard 20. Each pair of the supporters 224 is attached to the three annular ribs 220 and connecting the three annular ribs 220 together. The two pairs of the supporters 224 are evenly distributed along a circumference of the frame 22 of the fan guard 20, thereby reinforcing stability of the frame 22, when the hood 24 is brought to spread over the frame 22, enclose the frame 22 and supported by the frame 22 to achieve an assembly of the frame 22 and the hood 24. The hood 24 encloses a top and a periphery of the frame 22.

The hood 24 of the fan guard 20 is made of one of gauze and netting, whereby the fan guard 20 can prevent the fan from contamination of dust and damage during operation. The hood 24 is brought to cover the frame 22 along the top-to-bottom direction of the frame 22 until a bottom of the hood 24 resiliently engage with the lower annular rib 220 of the frame 22, and whereby the hood 24 is supported by the frame 22 and cooperates with the frame 22 to form the fan guard 20 having a fixed shape for passing through of the airflow produced by the fan 10. Thus, the hood 24 of the fan guard 20, which is made of one of gauze or netting, can not only protect the fan 10 from contamination of dust and but also reduce noise produced by the fan 10.

In assembly, the screws 30 are brought to extend the through holes 2202 of the fastening feet 2200 of the lower annular rib 220 of the frame 22 and screwed into the threaded holes 1200 of the upper ears 124 of the top portion of the body 12 of the fan 10, thereby firmly securing the fan guard 20 to the top portion of the body 12 of the fan 10. The fan guard 20 is then placed on an air intake of the fan 10 at the top portion of the body 12 of the fan 10.

In use, the airflow produced by the fan 10 passes through the fan guard 20 towards the fan 10, whereby the fan guard 20 installed on the top portion of the body 12 of the fan 10 protects the motor 14 of the fan 10 from contamination of dust and damage during operation.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A fan assembly comprising:

a fan comprising a plurality of ears; and a fan guard mounted on the fan, the fan guard comprising a frame and a hood covering on the frame and supported by the frame, the frame comprising a plurality of annular ribs and a plurality of supporters connecting the annular ribs together, the annular ribs being concentrically disposed along an axial direction of the fan guard and spaced apart with predetermined spacing;

wherein a lower annular rib comprises a plurality of fastening feet extending from a circumference thereof and wherein the fan guard is secured to the fan by fasteners extending through the fastening feet and engaging in the ears of the fan.

2. The fan assembly as claimed in claim 1, wherein the hood is made of one of gauze and netting and the frame is made of metal wires.

3. The fan assembly as claimed in claim 2, wherein the annular ribs comprise a middle annular rib has a diameter larger than that of any of the other annular ribs.

4. The fan assembly as claimed in claim 1, wherein the fan comprises a plurality of ears extending outwardly from a circumference thereof, the fasteners being extended through the fastening feet of the frame of the fan guard and screwed into the ears of the fan.

5. The fan assembly as claimed in claim 4, wherein the fan comprises a body and a motor received in the body, the ears being extended outwardly from a circumference of the body of the fan.

6. The fan assembly as claimed in claim 5, wherein the lower annular rib of the frame of the fan guard is positioned on a top portion of the body of the fan with the fastening feet of the frame of the fan guard corresponding to the ears of the body of the fan.

7. The fan assembly as claimed in claim 1, wherein the supporters are distributed along a circumference of the frame.

8. The fan assembly as claimed in claim 7, wherein the supporters are intercrossed at a top apex of the frame of the fan guard.

9. A fan assembly comprising:

a fan for generating an airflow and comprising a plurality of radailly extended ears; and a fan guard mounted on the fan, the fan guard comprising a frame and a hood made of net, mounted over the frame and enclosing top and periphery of the frame, the frame comprising a plurality of concentrically arranged annular ribs spaced from each along an axial direction and a plurality of supporters connecting the annular ribs together;

wherein a lowest one of the annular ribs comprises a plurality of fastening feet extending from a circumference thereof and corresponding to the ears of the fan and wherein the fan guard is secured to the fan by fasteners extending through the fastening feet and engaging in the ears of the fan.

10. The fan assembly of claim 9, wherein the annular ribs and the supporters are made of metal wires.

11. The fan assembly of claim 10, wherein the hood has an outwardly convex periphery.

12. The fan assembly of claim 11, where one of the annular ribs located near the lowest one of the annular ribs has a diameter which is larger than any of others of the annular ribs.

13. The fan assembly of claim 11, wherein the fastening feet are formed by bending the lowest one of the annular ribs.

14. A fan assembly comprising:

a fan comprising a plurality of ears; and a fan guard mounted on the fan, the fan guard comprising a frame and a hood made of one of gauze and netting, covering on the frame and supported by the frame, the frame comprising a plurality of annular ribs and a plurality of supporters connecting the annular ribs together, the annular ribs being concentrically disposed along an axial direction of the fan guard and spaced apart with predetermined spacing;

wherein a lower annular rib comprises a plurality of fastening feet extending from a circumference thereof and wherein the fan guard is secured to the fan by fasteners extending through the fastening feet and engaging in the ears of the fan.

* * * * *